US006152329A

United States Patent [19]

Rosenthal et al.

[11] Patent Number: 6,152,329

[45] Date of Patent: Nov. 28, 2000

[54] LOCKING DEVICE FOR A CLOSURE CAP

[75] Inventors: Karl-Heinz Rosenthal, Reichshof; Norbert Filip, Wiehl, both of Germany

[73] Assignee: Innocos Innovative Verpackungen fur Die Kosmetische Industrie GmbH, Wiehl, Germany

[21] Appl. No.: 09/077,865

[22] PCT Filed: Nov. 9, 1996

[86] PCT No.: PCT/DE96/02163

§ 371 Date: May 10, 1999

§ 102(e) Date: May 10, 1999

[87] PCT Pub. No.: WO97/21604

PCT Pub. Date: Jun. 19, 1997

[30] Foreign Application Priority Data

Dec. 8, 1995 [DE] Germany ..... 195 45 956

[51] Int. Cl.[7] ..... B67D 5/06

[52] U.S. Cl. ..... 222/153.14; 222/534; 222/536

[58] Field of Search ..... 222/153.14, 534, 222/536

[56] References Cited

U.S. PATENT DOCUMENTS 3,542,256 11/1970 Waterman ..... 222/534

3,786,964 1/1974 Landen ..... 222/534 X 4,424,920 1/1984 Tada ..... 222/153.14

FOREIGN PATENT DOCUMENTS 0 585 501 3/1994 European Pat. Off. .

0 603 090 6/1994 European Pat. Off. .

*Primary Examiner*—Joseph A. Kaufman

*Attorney, Agent, or Firm*—Reising, Ethington, Barnes, Kisselle, Learman & McCulloch, P.C.

[57] ABSTRACT

A closure cap for a container is disclosed which has a body disposed over the mouth of a container. The body has a passage for fluid flow from the mouth of the container to an opening. The closure cap also has a top plate pivotally attached to the body for movement between open and closed positions. A locking lever is provided which extends in the direction of the longitudinal axis and having a fulcrum so that the upper end of the locking lever can be located in the path of movement of the top plate when it is closed to thereby obstruct movement of the top plate to the open position.

18 Claims, 2 Drawing Sheets

LOCKING DEVICE FOR A CLOSURE CAP

FIELD OF THE INVENTION

The invention relates to a closure cap for the mouth of containers, particularly those used to store cleaning agents, cosmetics and the like, consisting of a main body which can be placed over the mouth of the container in fluid-tight fashion and has at least one product-metering opening which can be closed by a tubular sealing element, and a top plate, through which the media can flow, attached to the main body in pivoting fashion such that the container mouth can be sealed tight or opened as required.

BACKGROUND OF THE INVENTION

A sealing device of this kind is known from German Patent Application P 195 41 830. In the sealing device disclosed there, the product-metering opening is released by applying pressure to one side of the top plate, so that the medium contained in the container can flow out. The top plate can be locked in different positions by nibs, so that the product-metering opening can be opened more or less to increase or decrease the corresponding flow of product. However, the unintentional opening of the closure cap cannot be prevented. This is particularly problematic when the containers are transported and the closure cap is opened by objects striking or resting against the top plate, for example.

A sealing device for a container is known from EP-A-585 501 which has a separate component intended to prevent the top plate from being pressed down.

U.S. Pat. No. 4,424,920 discloses a pump for a container, where the pressing down of the pump button is intended to be prevented by locking elements provided on the pump station.

The invention is thus based on the task of further developing a generic closure cap such that it is impossible to open it unintentionally by pressing down the top plate.

SUMMARY OF THE INVENTION

According to the invention, the task is solved in that at least two slits are provided in the lateral surface of the main body which run essentially parallel to the longitudinal axis of the main body, thus forming a locking lever between the slits which is connected to the main body by bridges of material, and in that the top plate can be firmly locked in the closed position by the locking lever.

The closure cap is preferably designed such that the locking device engages at least one recess provided on the top plate, or can be positioned underneath the top plate. This provides for positive, secure locking.

At least two slits are provided in the lateral surface of the main body which run essentially parallel to the longitudinal axis of the main body, thus forming a locking lever between the slits which is connected to the main body by bridges of material. Designing the locking device as a locking lever in this way greatly simplifies the manufacture of the closure cap, as the locking lever need not be mounted as an additional component using nibs which rest in suitably designed recesses, for example, but rather can be integrally molded directly on the main body. Instead of the slits being integrally molded or provided for in the mold, they can be cut into the main body later on in the manner of the slits described above, thus forming a locking lever. Conventional closure caps, which have no locking lever and no recesses in the injection mold, can thus also be provided with a locking lever of this kind in a subsequent process. The bridges of material formed between the locking lever and the main body are designed such that they have adequate pretension and stability to ensure locking of the closure cap.

In a particularly preferred configuration, the lateral surface of the main body in the region of the locking lever has a recess whose lowest point is roughly located in the region of the bottom edge of the top plate in the closed state. Thus, the locking lever can easily engage under the bottom rim of the top plate without necessitating the provision of an additional locking device, such as a groove or the like, to engage the locking lever. If the upper face end of the locking lever projects slightly beyond the bottom rim of the top plate, the engaging of the locking lever under the top plate ensures that the connection is kept under tension and that the locking lever cannot pop out on its own.

It is particularly advantageous when the lateral surface of the main body has four slits running essentially parallel to the longitudinal axis of the main body, where two on the upper face end of the main body and two on the lower face end of the main body run towards one another, thus forming bridges of material between the opposing slits.

Each pair of slits running towards one another from the opposing face ends of the main body is preferably collinear. In this way, the locking lever is in the shape of a tab in the main body. The locking lever can also be of some other expedient shape, such as tapered. The closure cap according to the invention is preferably injection-molded from plastic. In order to emphasize the locking lever and its position more clearly, it can be of a different color than the remaining main body. Similarly, recesses, grids or signal words, such as "Press", can be integrally molded on the locking lever in order to clearly indicate its function to the user.

In closure caps in which the main body has a transverse wall essentially transverse to the longitudinal axis and mounted on the inside of the main body, the slits are preferably positioned such that the bridges of material are at the height of the transverse wall. This internal mount between the locking lever and the transverse wall increases the durability, as it forms another mounting surface in addition to the bridges of material. The mount between the transverse wall and the locking lever can be designed such that it exerts an additional recoil force or tension force on the locking lever.

In a preferred configuration of the closure cap according to the invention, at least one snap nib is provided for at least one of the slits on the side wall of the main body and/or the locking lever. The snap nib functions as a return stop for the locking lever. A suitable design of the snap nib ensures that the locking lever can only be shifted out of/into its intended position by applying a requires minimum recoil force. This makes it impossible to unintentionally release the locking lever. The contact force generated between the snap nibs is then greater than the recoil force exerted on the locking lever.

Snap nibs which engage one another are preferably provided on the opposing side walls of each slit. In this context, it is particularly advantageous when the snap nibs are positioned opposite one another.

The manufacture of the closure cap according to the invention can be further simplified by integrally molded the snap nibs on the main body and/or the locking lever in one piece.

An example of the closure cap according to the invention is illustrated in the drawings and described in detail below based on the drawings.

BEST MODE FOR CARRYING OUT THE INVENTION

Figure 1:
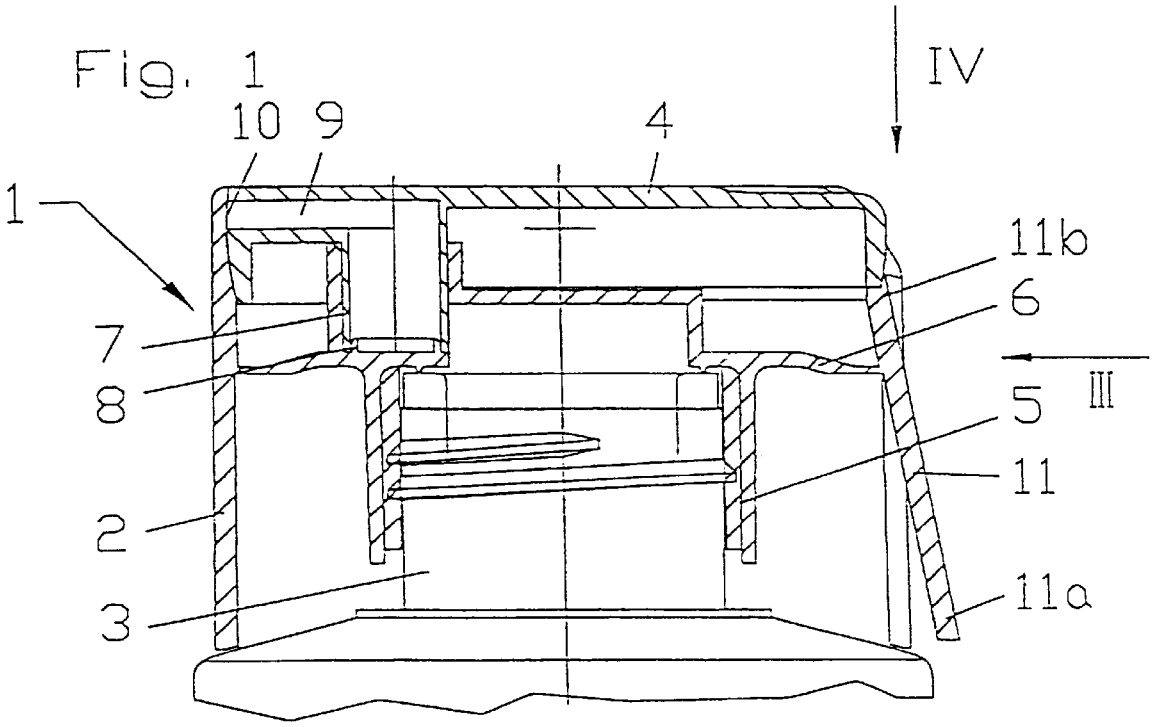
FIG. 1 A side sectional view of the closure cap according to the invention with the locking lever in the locked position, FIG. 2 The view from FIG. 1 with the locking lever released and the top plate open, FIG. 3 A side view of the closure cap according to the invention in the direction of arrow III in FIG. 1, FIG. 4 An enlarged view of the locking lever, viewed in the direction of arrow IV in FIG. 1, and FIG. 5 An enlarged view of the locking lever, viewed in the direction of arrow V in FIG. 2.

As the drawings show, closure cap 1 consists of a main body 2 on which a top plate 4 is mounted in tiltable fashion by way of nibs (not shown) which engage pockets. Closure cap 1 is mounted on container mouth 3 by way of a neck 5 provided with an inside thread. This mount can be designed to be releasable or non-releasable. Instead of a thread, neck 5 can also be mounted on container mouth 3 by way of other suitable methods, such as a snap closure. Neck 5 is mounted on the inside of the lateral surface of main body 2 by a transverse wall 6 running essentially transverse to the longitudinal axis of the closure cap.

Figure 2:
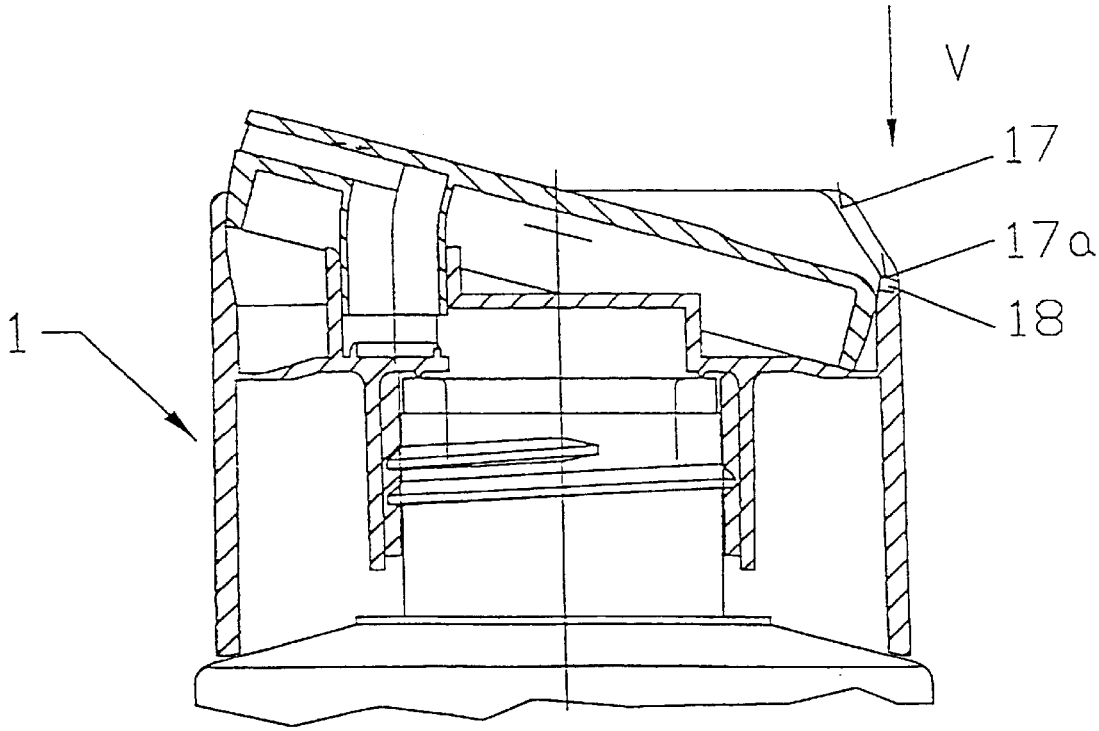

If the closure cap is moved from the closed position shown in FIG. 1 into the open position shown by way of example in FIG. 2 by pressing top plate 4, the lower face end of tubular sealing element 7 is moved away from sealing surface 8, the end of outlet channel 9 facing the inside wall of main body 2 tilts up and outlet opening 10 on the end of outlet channel 9 is thus positioned above the rim of main body.

However, before the closure cap is opened, locking lever 11, which engages underneath the lower rim of top plate 4, must be moved from the closed position. The user does this by applying pressure to lower end of the locking lever 11*a*. With the lever arm of locking lever 11, the force applied in this way releases locking lever 11 from its closed position. The fulcrum of the lever arm is at bridges of material 12, on which a torque is exerted by way of the lever arm. The material properties of the plastic of bridges of material 12 generates the corresponding recoil force of locking lever 11. Locking lever 11 can also be molded from the start such that it runs transverse to the lateral surface of main body 2, so that upper end 11*b* always automatically assumes the closed position and can only be moved from this closed position by intentionally applying pressure to lower end of the locking lever 11*a*.

Figure 3:
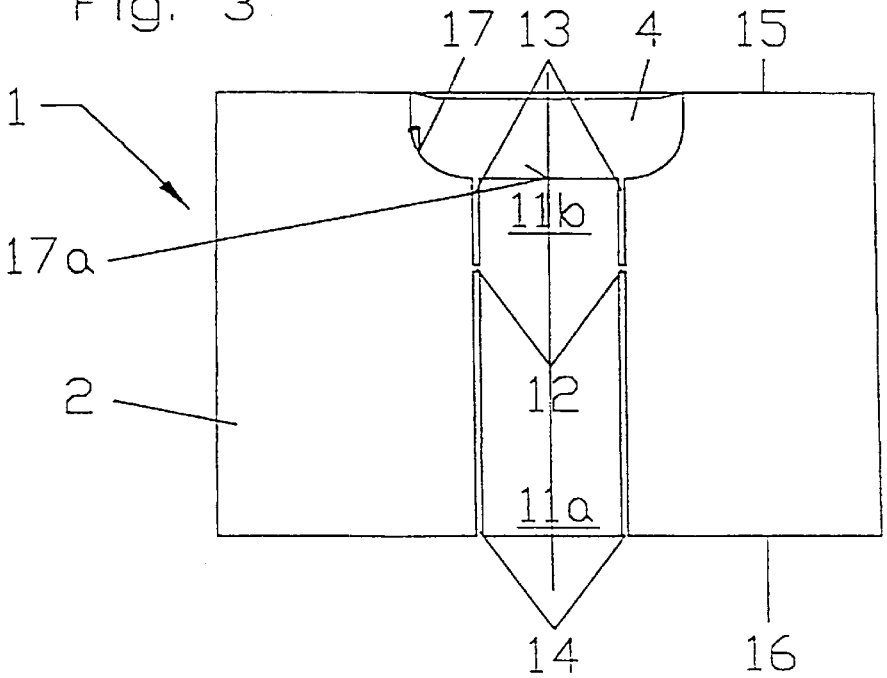

The design of locking lever 11 is particularly clear in FIG. 3. The lateral surface of main body 2 has four slits 13, 14 running essentially parallel to the longitudinal axis of main body 2, where two on the upper face end of the main body 15 and two on the lower face end of the main body 16 run towards one another, such that bridges of material 12 are formed between them. In the configuration illustrated in FIG. 3, slits 13 and 14 run parallel to the longitudinal axis of main body 2. Of course, they can also run at an angle to the longitudinal axis of main body 2.

The lateral surface of main body 2 in the region of locking lever 11 has a recess 17 whose lowest point 17*a* is roughly located in the region of the bottom edge of top plate 4. In the closed position, top plate 4 rests on upper end of the locking lever 11*b* and locks it such that the unit is kept under constant pretension and it is impossible for the closure cap to open voluntarily.

Alternatively, the closure cap can also be designed such that lowest point of the recess 17*a* is located above upper end of the locking lever 11*b*. In this case, locking lever 11 then runs transverse to the lateral surface of main body 2, so that it is automatically in the transverse position and need not be held in this position by top plate 4.

As shown in FIG. 2, in particular, the inside of the upper end of the locking lever has a snap pocket 18, against which at least the outer peripheral side of top plate 4 can be positioned. In the closed position, the outer peripheral edge of top plate 4 rests inside this snap pocket 18, as a result of which the positive fit ensures a tighter fit of locking lever 11. At the same time, the locking lever is prevented from being forced underneath top plate 4 during locking and possibly breaking off.

However, the inside of locking lever 11 can also be provided with an additional tab (not shown) which intentionally engages around the lower edge of top plate 4. In this case, the plastic of the closure cap, or of this tab, can be designed in two ways. On the one hand, it can be designed such that it releases the top plate when the locking lever is released by applying a specific, pre-determined force and, on the other hand, it can be designed such that it breaks off during this release procedure. The second solution thus also represents a tamper-proof seal for closure cap 1 according to the invention.

Figure 4:
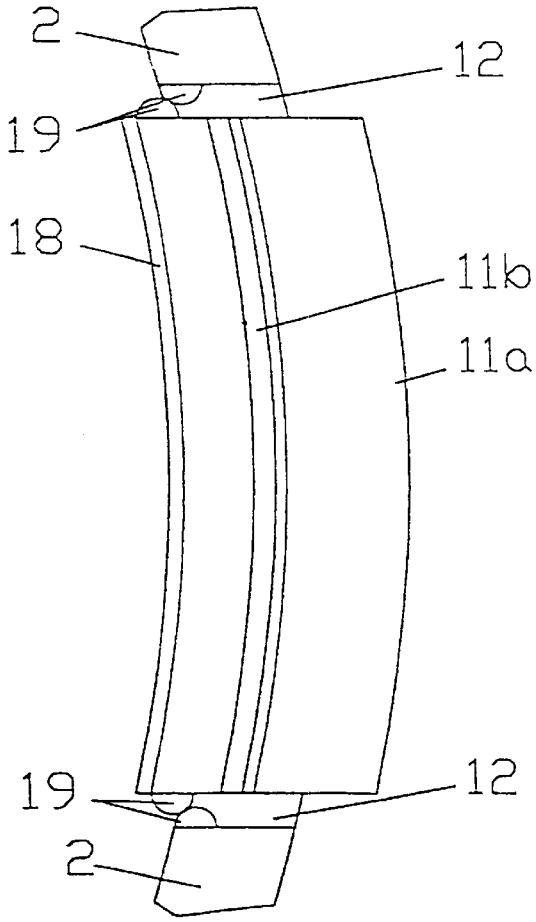
Figure 5:
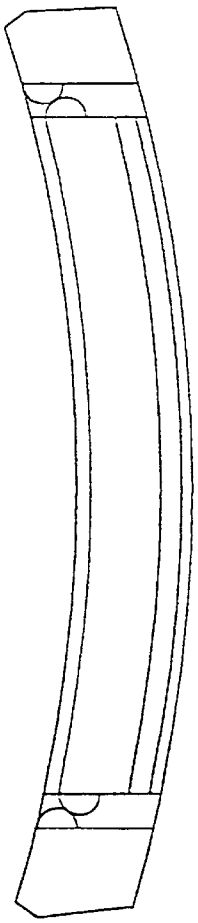

As is shown particularly clearly in FIGS. 4 and 5, snap nibs 19 are integrally molded on the side walls of the main body and the locking lever in one piece in the region of slits 13 described above. These snap nibs 19 are positioned such that they are opposite one another and are so large that they cannot slide by one another without an externally applied force. In FIG. 4, locking lever 11 is shown in its closed position. In order to move locking lever 11 into the open position, illustrated in FIG. 5, the minimum force to be applied must be exceeded by pressing on locking lever 11, so that snap nibs 19 are forced back due to the elasticity of the plastic and the snap nibs can slide by one another into the position illustrated in FIG. 5. Thus, the closure cap can only be unlocked if the minimum force is applied, thus making unintentional unlocking virtually impossible. At the same time, however, snap nibs 19 also hold locking lever 11 in its unlocked position, meaning that the user does not have to press locking lever 11 every time in order to open the closure cap and draw the medium out of the container. In FIGS. 4 and 5, the snap nibs are located on upper end of the locking lever 11*b*. Of course, they can also be located at other suitable points along slits 13 and 14, or several snap nibs can be provided, as a result of which the corresponding minimum force to be applied in order to unlock the locking lever becomes correspondingly larger.

Bridges of material 12 need not be located in the position shown in FIG. 3. They can also be located on lower end of the locking lever 11*b*, or on upper end of the locking lever 11*a*, this again changing the minimum force to be applied. They can also be designed much wider than illustrated in FIG. 3, this correspondingly changing the recoil force or the force to be applied for unlocking to suit the conditions of use.

Locking lever 11 need not necessarily be as long as shown in FIG. 3. It can also be designed much shorter than the rest of closure cap 2, or extend beyond lower face side of the main body 16, so that it engages a corresponding recess provided on the container, for example.

The closure cap according to the invention makes it possible to prevent unintentional opening, for example during transport. By varying the material design of the closure cap and the arrangement of snap nibs, the force to be applied for unlocking can be selected as desired to suit the conditions of use. The manufacture of the closure cap according to the invention is particularly simple, as no additional parts for the locking lever need be fitted in separate steps, but rather the entire closure cap can be injection-molded in one piece. By appropriately designing the bridges of material and snap nibs, the lever can be fixed in either its closed or open position. In addition, the locking lever can be integrally molded on the main body such that it automatically assumes the closed position.

Alternate Designs

In another advantageous configuration, a snap pocket is provided on the inside of the upper face end the locking lever, against which at least the outer peripheral side of the closure cap can be positioned. On the one hand, this snap pocket ensures the proper seating of the locking lever of the closure cap in the closed position. On the other hand, it also prevents the locking lever from sliding under the closure cap due to the application of excessive forces, and possibly breaking off due to resultant excessive torsional forces. If it were to slide out, the closure cap would also no longer be held in its intended position or the closed position. Similar to the snap pocket, a snap tab which engages around the closure cap in the closed position can, of course, also be provided. This tab can then also be designed such that it breaks off when the locking lever is moved from its closed position to the open position. In this way, the locking lever simultaneously functions as a tamper-proof seal.

The injection molds for the closure cap can be designed such that the locking lever is transverse to the lateral surface of the main body. This increases the pretension of the locking lever. This can also ensure that the locking lever automatically moves into the closed position, without having to be pretensioned by the user. The user must then deliberately remove the locking lever each time in order to expose the product-metering opening of the closure cap.

On a closure cap designed without a recess and snap pocket, the inside of the upper end of the locking lever is preferably provided with at least one nib which can be positioned underneath the rocker arm or which engages a recess provided on the rocker arm. A positive fit is thus realized even without a recess. Of course, the reverse is also conceivable, i.e. that the rocker arm is provided with a nib which engages a groove corresponding to the rocker arm.

In a particularly advantageous configuration of the closure cap according to the invention, the top plate is designed as a lid. The lid rests on the entire rim of the upper face end of the main body. However, the top plate may also extend over only a specific area of the upper section of the closure cap, such that it forms a strip which can move inside the closure cap surrounding it.

Although the description of this invention has been given with reference to a particular embodiment, it is not to be construed in a limiting sense. Many variations and modifications of the invention will now occur to those skilled in the art. For a definition of the invention, reference is made to the appended claims.

What is claimed is:

1. In a closure cap (1) for a container for fluid, said container having a mouth at its upper end, said closure cap being of the type comprising a main body (2) disposed over the mouth (3) of the container in fluid tight relation, said main body having longitudinal axis and having a lateral opening with a movable sealing element, a top plate (4) having a passage for fluid flow from the mouth of said container to said opening, said top plate (4) being pivotally attached to said main body (2) for movement between open and closed positions whereby the container mouth (3) can be sealed or opened by movement of said sealing element with said top plate (4), the improvement comprising:

said main body (2) includes a locking lever (11) which extends in the direction of said longitudinal axis, said locking lever having free upper and lower ends **(11*a*, 11*b*) with a fulcrum comprising hinges (12) unitary with said lever and said main body, the upper end of said locking lever (11) being located in the path of movement of said top plate (4)** when the top plate is closed to obstruct movement of the top plate to the open position.

2. A closure cap as defined in claim 1 wherein:

said locking lever (11) is inclined outwardly from said longitudinal axis at its upper end.

3. A closure cap as defined in claim 1 or 2 wherein:

the locking lever (11) engages a recess on the top plate (4).

4. A closure cap as defined in claim 1 or 2 wherein:

the lateral surface of the main body (2) in the region of the locking lever (11) has a recess (17) with a lower end **(17*a*) adjacent the lower edge of the top plate (4)** in the closed position.

5. A closure cap as defined in claims 1 or 2 wherein:

said upper end **(11*b*) of said locking lever (11) is bounded by a pair of slits (13) on its opposite sides, said lower end (11*a*) of said locking lever (11) is bounded by a pair of slits (14) on its opposite sides, said slits (13,14) defining said hinges, each of said hinges (12) being disposed between each pair of slits (13,14)**.

6. A closure cap as defined in claim 5 wherein:

the slit (13) and the slit (14) on one side of said locking lever (11) are collinear with each other and the slit (13) and the slit (14) on the other side of the locking lever (11) are collinear with each other.

7. A closure cap as defined in claim 5 wherein:

all of said slits (13,14) extend substantially parallel to the longitudinal axis of the main body (2).

8. A closure cap as defined in claim 5 wherein:

the main body (2) has a transverse wall (6), mounted on the inside of the main body (2), the slits (13,14) being located such that the transverse wall (6) joins the locking lever (11) at the pivot axis defined by the hinges (12).

9. A closure cap as defined in claim 5 wherein:

at least one snap nib (19) is disposed adjacent one of the slits (13,14) on the side wall of the main body (2) for elastically resisting pivoting of the locking lever (11) between a first position which obstructs movement of the top plate (4) and a second position which does not obstruct movement of said top plate.

10. A closure cap as defined in claim 5 wherein:

at least one snap nib (19) is disposed adjacent to one of the slits (13,14) on the locking lever (11) for elastically resisting pivoting of the locking lever (11) between a first position which obstructs movement of the top plate (4) and a second position which does not obstruct movement of said top plate.

11. A closure cap as defined in claim 5 wherein:

a first snap nib (19) is disposed adjacent one of the slits (13,14) on the side wall of the main body (2) and a second snap nib (19) is disposed opposite said first snap nib on said locking lever (11) for elastically resisting pivoting of the locking lever (11) between a first position which obstructs movement of the top plate (4) and the second position which does not obstruct movement of said top plate.

12. A closure cap as defined in claim 1 or 2 wherein:

a snap pocket (18) is disposed on the inside of the upper end of the locking lever (11*b*), said top plate (4) having a peripheral edge seated in said snap pocket when said top plate is closed.

13. A closure cap as defined in claim 1 or 2 wherein:

a snap tab on the upper end of the locking lever (11*b*), said tab engaging the top plate (4) when said plate is closed for resisting sliding movement of said locking lever under the lower edge of the main body (2).

14. A closure cap as defined in claim 1 or 2 wherein:

a snap tab on the upper end of the locking lever (11*b*), said tab engaging the top plate (4) when said plate is closed, said tab being frangible so that it is broken when the locking lever is moved from its closed position to its open position whereby the tab functions as a tamper-proof seal.

15. In a closure cap (1) for a container for fluid, said container having a mouth at its upper end, said closure cap being of the type comprising a main body (2) disposed over the mouth (3) of the container in fluid tight relation, said main body having longitudinal axis and having a lateral opening with a movable sealing element, a top plate (4) having a passage for fluid flow from the mouth of said container to said opening, said top plate (4) being pivotally attached to said main body (2) for movement between open and closed positions whereby the container mouth (3) can be sealed or opened by movement of said sealing element with said top plate (4), the improvement comprising:

said main body (2) includes a locking lever (11) which extends in the direction of said longitudinal axis, said locking lever having free upper and lower ends (11*a*, 11*b*) with a fulcrum comprising hinges (12) unitary with said lever and said main body, the upper end of said locking lever (11) being located in the path of movement of said top plate (4) when the top plate is closed to obstruct movement of the top plate to the open position, said locking lever (11) engaging a recess on the top plate (4) and the lateral surface of the main body (2) in the region of the locking lever (11) having a recess (17) with a lower end (17*a*) adjacent the lower edge of the top plate (4) in the closed position.

16. A closure cap as defined in claim 15 wherein:

said upper end (11*b*) of said locking lever (11) is bounded by a pair of slits (13) on its opposite sides, said lower end (11*a*) of said locking lever (11) is bounded by a pair of slits (14) on its opposite sides, said slits (13,14) defining said hinges, each of said hinges (12) being disposed between each pair of slits (13,14).

17. A closure cap as defined in claim 16 wherein:

at least one snap nib (19) is disposed adjacent one of the slits (13,14) on the side wall of the main body (2) for elastically resisting pivoting of the locking lever (11) between a first position which obstructs movement of the top plate (4) and a second position which does not obstruct movement of said top plate.

18. A closure cap as defined in claim 17 wherein:

a snap tab on the upper end of the locking lever (11*b*), said tab engaging the top plate (4) when said plate is closed for resisting sliding movement of said locking lever under the lower edge of the main body (2).

* * * * *